US006071141A

United States Patent [19]

Semmeling et al.

[11] Patent Number: 6,071,141

[45] Date of Patent: Jun. 6, 2000

[54] CONNECTOR LATCHES

[75] Inventors: Ralph A. E. M. Semmeling, Vlijmen, Netherlands; Andrew G. Meller, Stockholm, Sweden

[73] Assignee: Berg Technology, Inc., Reno, Nev.

[21] Appl. No.: 09/078,894

[22] Filed: May 14, 1998

[51] Int. Cl.[7] ..... H01R 13/627

[52] U.S. Cl. ..... 439/353; 439/953

[58] Field of Search ..... 439/352, 353, 439/357, 358, 953

[56] References Cited

U.S. PATENT DOCUMENTS

| | | | |
|---|---|---|---|
| 2,636,070 | 4/1953 | Judisch | 173/361 |
| 3,394,337 | 7/1968 | Miller | 339/91 |
| 4,698,025 | 10/1987 | Silbernagel et al. | 439/79 |
| 4,807,358 | 2/1989 | Dechelette et al. | 29/857 |
| 4,838,808 | 6/1998 | Fujiura . | |
| 4,975,075 | 12/1990 | Jinno et al. | 439/353 |
| 5,015,199 | 5/1991 | Hirano et al. | 439/353 |
| 5,021,002 | 6/1991 | Nochese . | |
| 5,030,127 | 7/1991 | Blasko | 439/353 |
| 5,083,933 | 1/1992 | Colleran et al. | 439/357 |
| 5,158,473 | 10/1992 | Takahashi et al. | 439/353 |
| 5,234,357 | 8/1993 | Yamaguchi | 439/354 |
| 5,257,947 | 11/1993 | Scheer et al. | 439/567 |
| 5,277,627 | 1/1994 | Matsuzaki | 439/677 |
| 5,352,133 | 10/1994 | Sampson | 439/357 |
| 5,354,214 | 10/1994 | Aso et al. | 439/492 |
| 5,356,300 | 10/1994 | Costello et al. | 439/101 |
| 5,391,090 | 2/1995 | Power | 439/354 |
| 5,397,246 | 3/1995 | Defibaugh et al. | 439/352 |
| 5,472,351 | 12/1995 | Greco et al. | 439/353 |
| 5,478,253 | 12/1995 | Biechler et al. | 439/181 |
| 5,486,117 | 1/1996 | Chang | 439/357 |
| 5,487,678 | 1/1996 | Tsuji | 439/352 |
| 5,496,190 | 3/1996 | Ittah | 439/354 |
| 5,569,047 | 10/1996 | Pauza | 439/353 |
| 5,584,718 | 12/1996 | Sukegawa | 439/352 |
| 5,609,499 | 3/1997 | Tan | 439/353 |
| 5,613,870 | 3/1997 | Traver, Jr. . | |

FOREIGN PATENT DOCUMENTS 0 718 918 A1 6/1996 European Pat. Off. .

*Primary Examiner*—Khiem Nguyen
*Assistant Examiner*—Javaid Nasri
*Attorney, Agent, or Firm*—Daniel J. Long; Brian J. Hamilla; M. Richard Page

[57] ABSTRACT

Electrical connectors having latches for holding the connectors in mated condition employ relatively long latch arms with a point of flexure near a rear end of the connector. The latches extend into locating posts positioned forwardly of the mating face of the connector. If multiple latch arms are used, they are interconnected by a commonly actuated cross bar. Latch arms may be formed by integrally molding the arms with covers of the connectors. Effective latching properties and a long life are achieved with such latch structures. Manufacturing costs may be reduced by integrally molding latches with covers of the connector.

12 Claims, 8 Drawing Sheets

CONNECTOR LATCHES

BACKGROUND OF THE INVENTION

1. Field of the Invention

This invention relates to electrical connectors. It has specific applicability to latching systems for securing intermating connectors together.

2. Brief Description of Prior Development

A latching mechanism for cable connectors for mobile telephones having latches disposed in forwardly extending locating posts has been proposed. In this connector, the latches are operated by pressing on a hinged actuator part formed from a portion of one of the covers.

In that design, the latches are unconnected individual pieces. When pressing on the hinged actuator portion of the plastic cover, because of the flexibility of the plastic hinge, the user must press almost exactly in the middle of the actuator to release both latches simultaneously to unlatch the connector. Pressing at a point spaced from the middle causes one latch to disengage, while the other latch stays locked.

SUMMARY OF THE INVENTION

Connectors according to the invention employ relatively long latch arms that extend from a distal portion near the mating face of the connector, rearwardly along or through the insulative terminal housing to a rearwardly disposed fulcrum point. The fulcrum point may be located adjacent or associated with a cover that overlies the terminal housing. The latch arms may be formed of separate metallic members or may be integrally molded with the cover. If plural, laterally spaced latching arms are used, they are joined by a cross member to insure common actuation.

DETAILED DESCRIPTION OF THE PREFERRED EMBODIMENTS

The connector system described herein was developed primarily for mobile wireless telephones and will be described in that context. However, the invention is believed to have utility for many other types of interconnections wherein connectors must be latched together.

Figure 1:
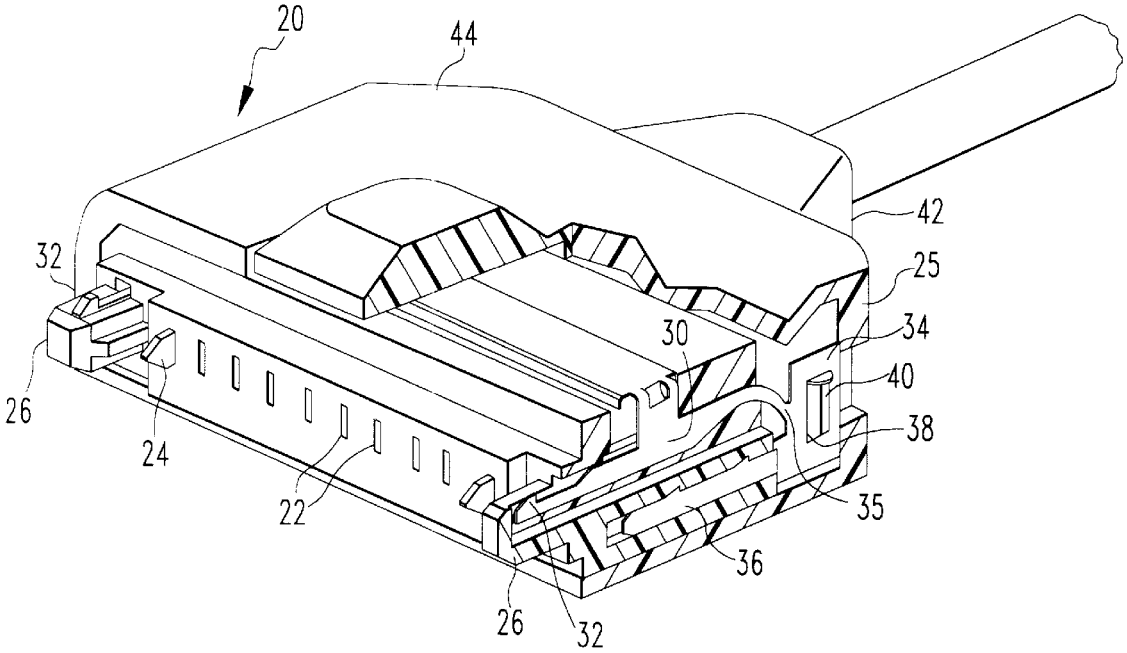
FIG. 1 is an isometric view of a first embodiment of the invention.
Figure 4:
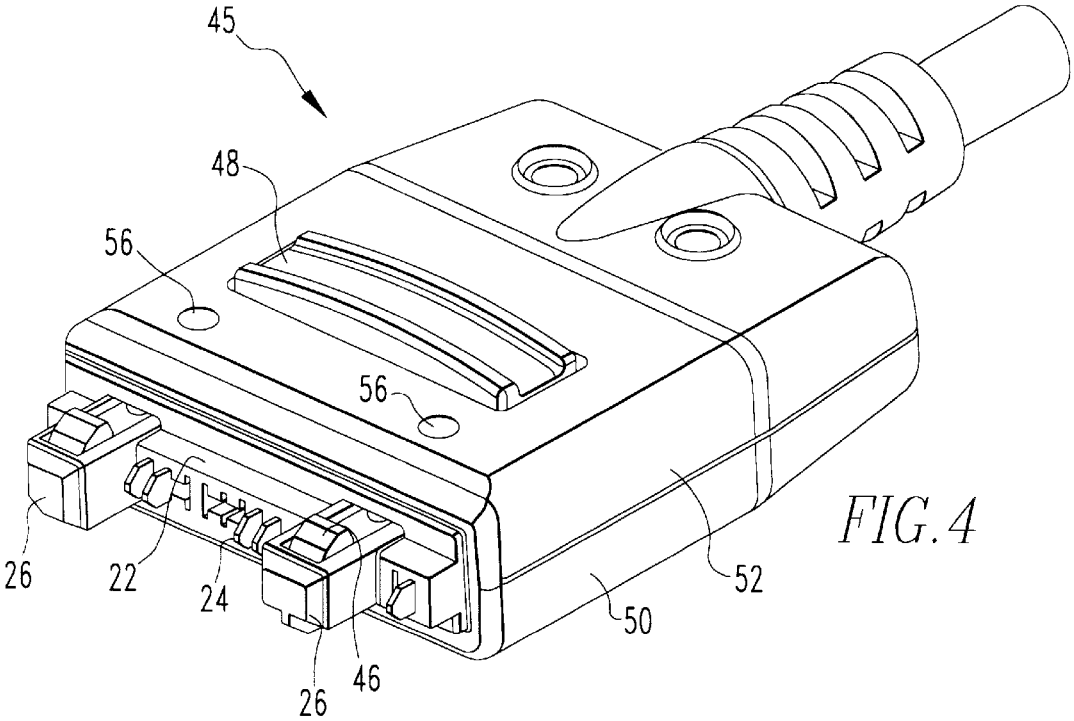
FIG. 4 is an isometric view of a fourth embodiment of cable connector.

A cable connector employing the invention is illustrated as a first embodiment in FIG. 1. In this and subsequent embodiments, similar elements will be given the same reference numerals. Cable connector 20 includes a terminal block or housing 22 formed of a molded insulative material. The housing includes a front face along which an array of a plurality of contact terminals 24 are disposed. In FIG. 1, only the end most terminals 24 are illustrated for drawing simplicity. In this and the other illustrated embodiments, the contacts 24 are essentially compression contacts that are slideable axially within slots in the terminal block. The contacts 24 are spring biased to a forward position extending beyond the front face of the terminal block. Such contacts are illustrated in published European Patent Specification No. EP 0 718 918, the disclosure which incorporated herein by reference, and no further explanation thereof is deemed necessary. The insulative housing 22 also includes a pair of laterally spaced guidance/locating posts that can include polarizing features for insuring correct mating orientation when mating with a receptacle connector. The front terminal-carrying face of the housing 22 may extend laterally outwardly beyond the pegs 26 to carry associated additional contact terminals 24, as shown in FIG. 4. An outer body or cover 28, preferably of a molded material such as a thermoplastic polymer, overlies the housing 22.

Figure 13:
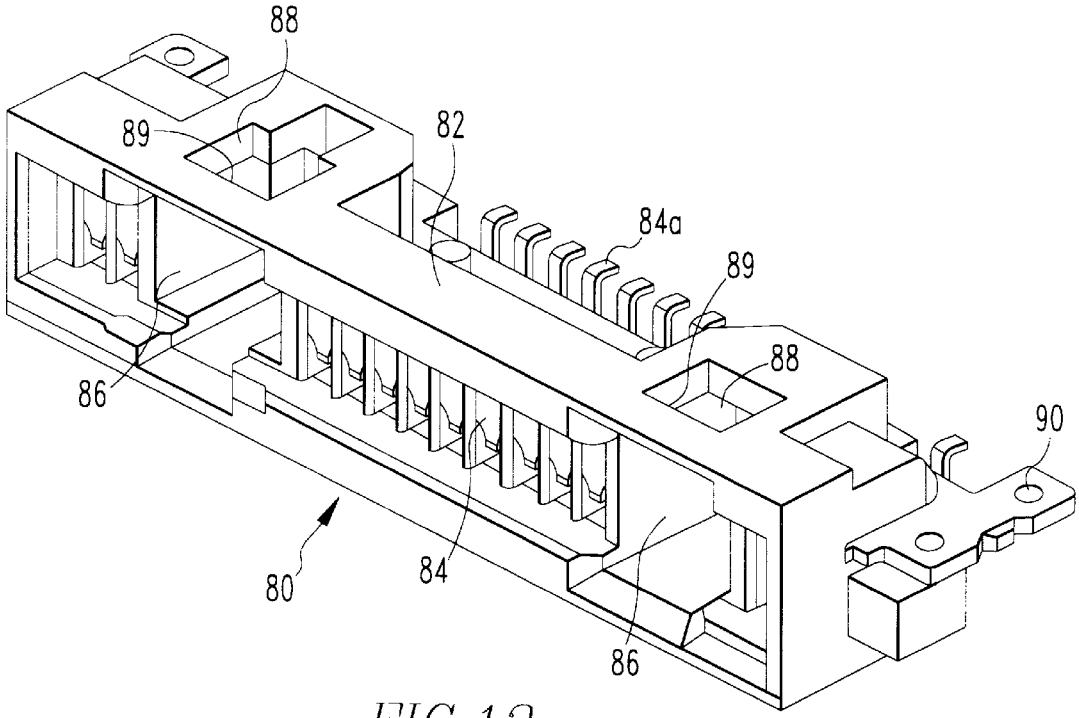
FIG. 13 is an isometric view of a receptacle connector to which previously illustrated embodiments of plug connectors are mateable.

The plug connector 20 is intended to mate with a receptacle connector of the type generally illustrated in FIG. 13. Because the terminals 24 are spring biased in order to develop sufficient axial contact normal forces by compression against stationary contacts 84 of the receptacle connector, there is inherently in this system a force that tends to separate the two connectors. To counteract this force, it is necessary to latch the plug and receptacle connectors together during use. To this end, latch arms 30 are utilized. In the embodiment of FIG. 1, a pair of spring biased latch arms 30, comprising substantial mirror images of each other, are integrally joined together by a cross member 42. The assembly comprising arms 30 and the cross member 42 is ideally stamped in a single piece from a suitable metallic flat stock. Each latch arm 30 includes a distal portion carrying a latch pawl 32 disposed in one of the guide/locating post 26, an intermediate portion extending along or through the housing 22 to a rearwardly disposed fulcrum point 35. In the embodiment illustrated in FIG. 1, each latch arm also includes a base 34 from which the latch arm extends. The base 34 includes a mounting element, such as the barbed stake 36, that is received in a slot in the housing 22 for securing the latches onto the housing 22. The base 34 also includes a means for securing the latches onto cover 28. As shown, the securing structure includes an opening 38 in base 34 that receives a mounting lug 40 integrally molded with the cover 28. The securing means also functions as a means for retaining the terminal housing 22 within the cover. The cover 22 also includes an integrally formed push button 44 that is positioned to be pressed against the crossbar 42. The assembly comprising the latches 30 and crossbar 42 is formed of a resilient material so that each latch arm 30 can be deflected about fulcrum 35 over many cycles.

The functioning of the latch structure of 20 is evident from FIG. 1. Assuming that the connector is in a latched state connected with its mating receptacle connector, in order to separate the connectors, the user presses downwardly on push button 44. Downward movement of the push button causes downward movement of cross member 42, which in turn imparts movement equally to both latch arms 30. Each latch arm 30 resiles about its fulcrum 35 downwardly, thereby withdrawing the latch pawls 32 beneath the surfaces of posts 36. This description suffices to outline the means utilized for unlatching the connector 20 to permit its withdrawal from the mating receptacle connector. When finger pressure is removed from push button 44, the latch arms 30 return to their original position, with the latch pawls 32 extending outwardly from the posts 26.

Figure 2:
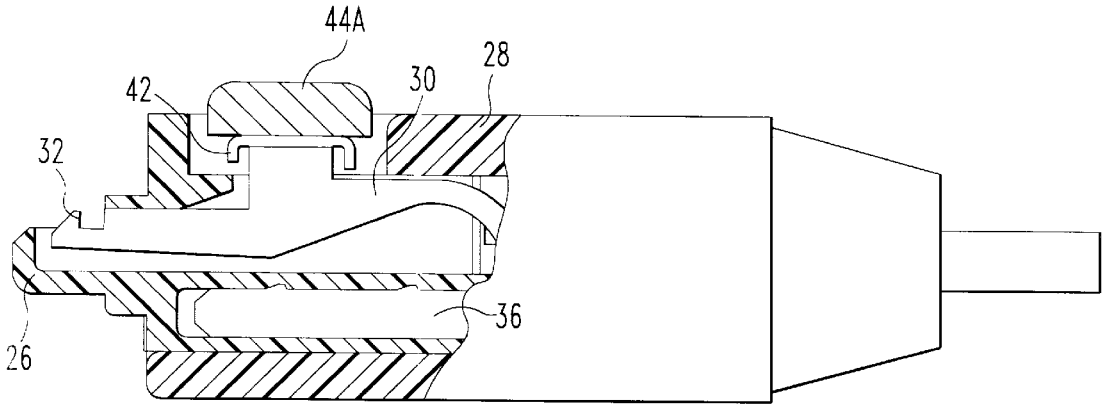
FIG. 2 is a side, partially sectional view of a second embodiment of a cable connector similar to that shown in FIG. 1.

FIG. 2 illustrates an alternative embodiment in which the push button 44A is a separate element that is secured onto the crossbar 42 and extends beyond a surface of the cover 28 to be engaged by the finger of the user.

Figure 3:
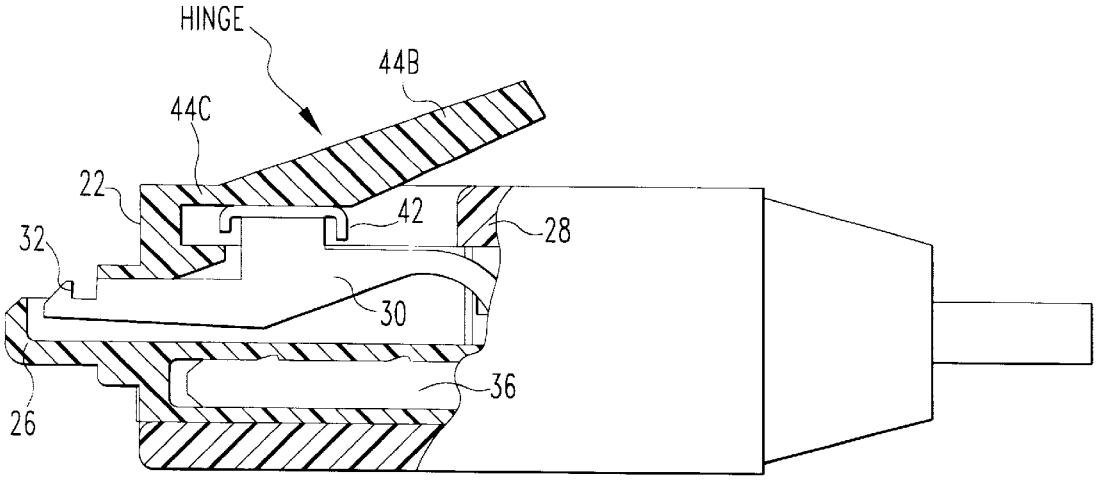
FIG. 3 is a third embodiment of a cable connector similar to that shown in FIG. 1.

FIG. 3 illustrates another embodiment of the plug connector shown in FIG. 1, in which the latch actuating member 44B is formed as an integral part of the terminal housing 22. In this embodiment, the latch actuating member is connected by a forwardly located hinged portion 44C to the housing 22. Pressing downwardly on the free end of the member 44B causes it to rotate about the hinged section 44C, thereby depressing crossbar 42 and ultimately latch arms 30.

FIG. 4 illustrates an embodiment of a plug type cable connector having a terminal housing 22 with a front mating face carrying terminals 24. The mating face includes a pair of locating/guidance posts 26. Within each of the posts 26 is a latch pawl 46. The latches are actuated by an actuation means comprising a push button 48. The rear portion of the terminal housing 22 and the cable connections are housed within a cover comprising a lower cover section 50 and an upper cover section 52.

Figure 5:
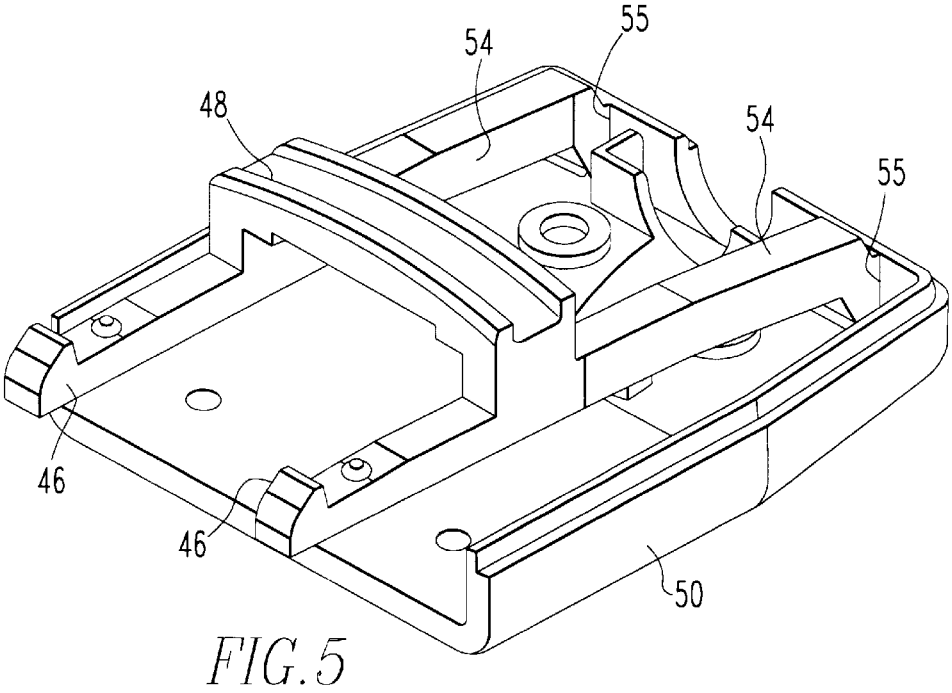
FIG. 5 is an isometric view of the cover and latch arm structure of the connector shown in FIG. 4.

FIG. 5 illustrates a complete lower cover assembly 50 that is used in the connector 45 of FIG. 4. The cover 50 is formed of a moldable material, preferably an insulative thermoplastic material. A pair of latch arms 54, each with a latch pawl 46 and the push button 48 are integrally molded with the lower cover 50. The distal portions of the latch arms 54 carry latch pawls 46. The proximal portions 55 of the latch arms 54 form fulcrums near their junctions with the cover 50. In this embodiment, push button 48 also provides the linking function of cross member 42 of FIG. 1.

Figure 6:
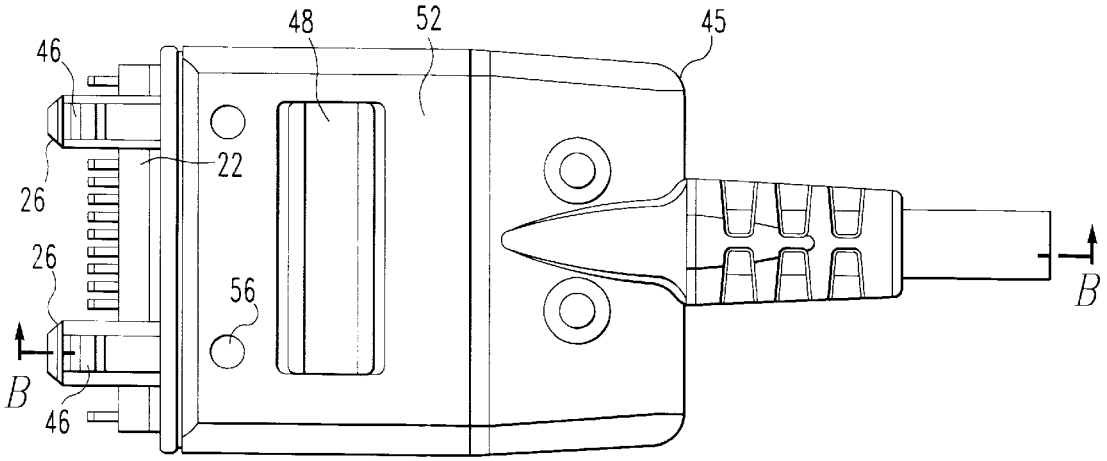
FIG. 6 is a top view of the connector shown in FIG. 4.
Figure 7:
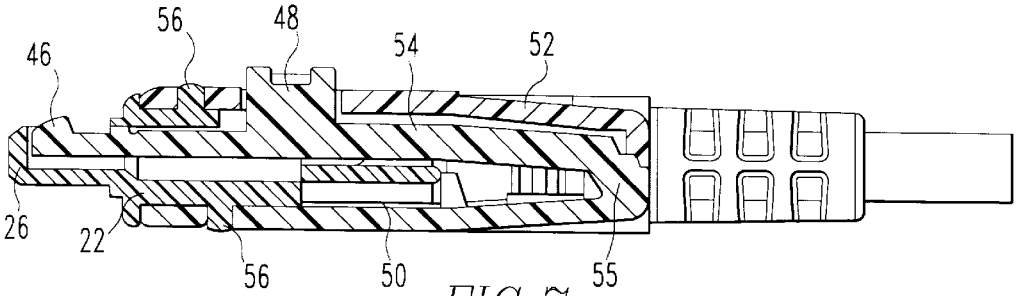
FIG. 7 is a side cross-sectional view of the connector shown in FIG. 4 taken along line BB of FIG. 6.

FIG. 6 is a top view of the plug shown in FIG. 4, with the push button 48 extending through an opening in the top cover 52. The latch pawls 46 are shown positioned in the locating/guidance posts 26. As shown in the cross-sectional view of FIG. 7, the terminal housing 22 is received in the lower cover 50 with the latch arm 54 extending from the rear of the bottom cover 50 at it proximal fulcrum 55 to a forwardly extending location, with the distally located latch pawl 46 positioned in posts 26. The top cover 52 mates with the bottom cover 50 to form an complete enclosure, with the push button 48 extending through an opening in the top cover 52. The covers 50 and 52 may be secured together by suitable techniques such as adhesives, solvent or heat welding or the like. The retention pegs 56 formed on the terminal housing 22 are received in openings in the covers 50 and 52, so that the covers securely hold the housing 22. This embodiment operates substantially in the same way as the FIG. 1 embodiment. Construction of the latch arms and cover in this fashion allows relatively long latch arms to be formed, with an improved ability to withstand repeated flexure. The arrangement of integrally molded covers and latch parts also reduces manufacturing costs.

Figure 8:
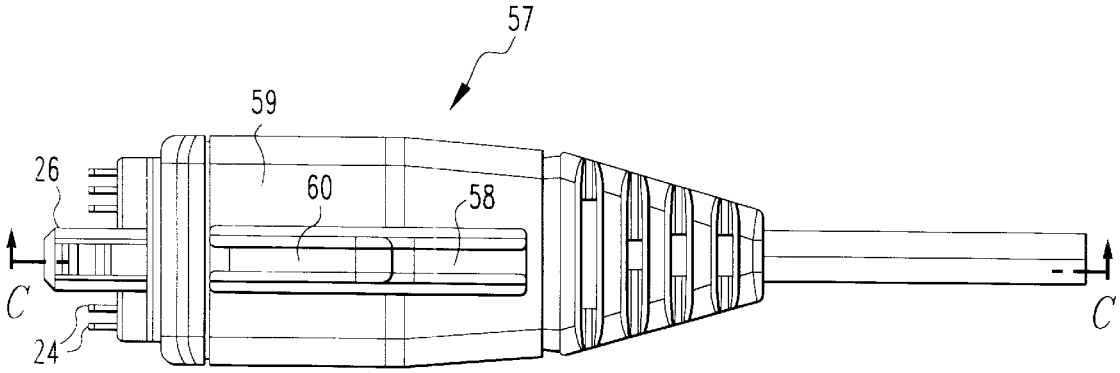
FIG. 8 is a top view of another embodiment of cable connector.
Figure 9:
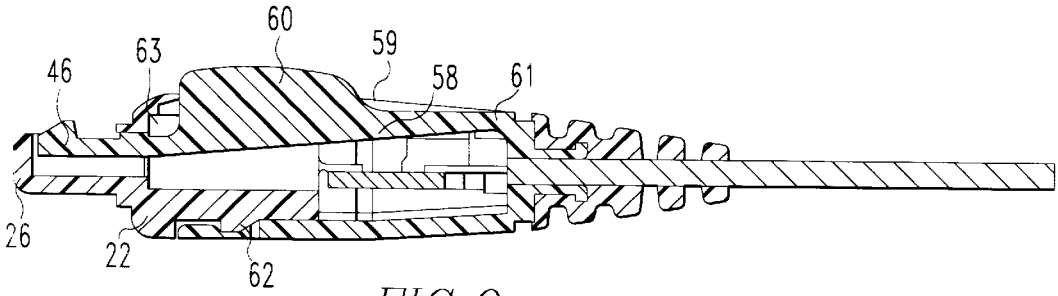
FIG. 9 is a side cross-sectional view of the connector of FIG. 8 taken along line CC of FIG. 8.

FIGS. 8 and 9 show another embodiment of cable plug connector 57 that is narrower than those previous described. The connector 57 preferably includes a one-piece molded cover 59. The cover 59 includes an integrally formed latch arm 58. The latch arm 58 includes an actuation enlargement 60 extending above the surface of the cover 59. As with previous embodiments, the latch arm 58 includes a latch pawl 56 disposed at a distal end and positioned within a locating post 26 of the terminal housing 22. The intermediate portion of the latch arm 58 extends through a slot 63 in the terminal housing 22. The latch arm 58 is connected at a fulcrum junction point 61 with the cover 59. The terminal housing 22 is secured within the cover 59 by one or more retention lugs 62, that engage suitable locating openings in the cover 59.

Figure 10:
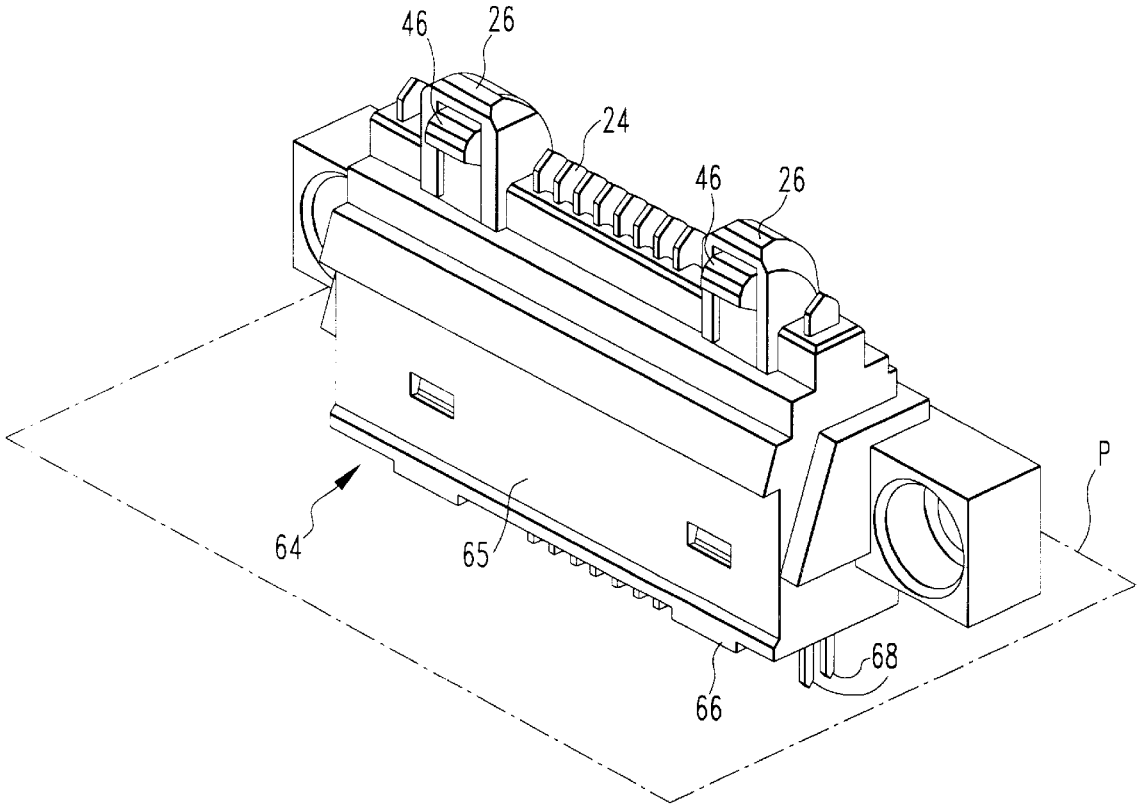
FIG. 10 is an isometric view of a printed circuit board connector employing the invention.
Figure 11:
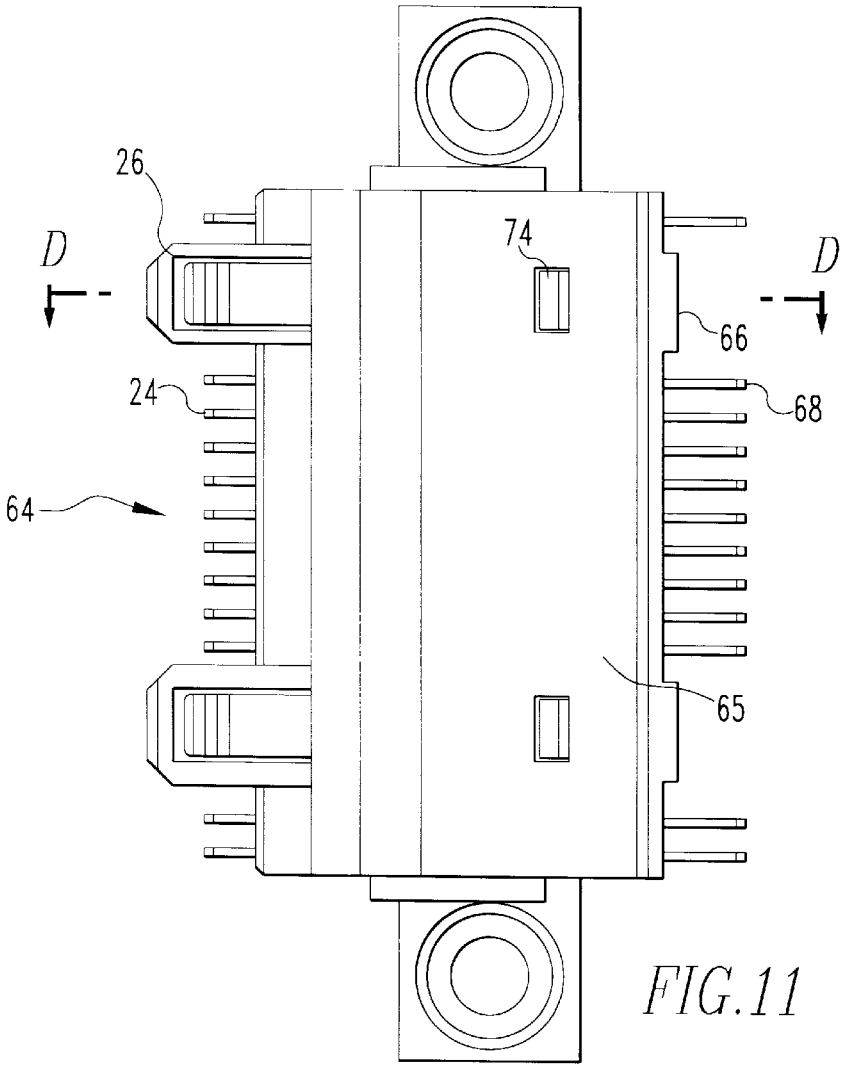
FIG. 11 is a top view of the connector shown in FIG. 10.
Figure 12:
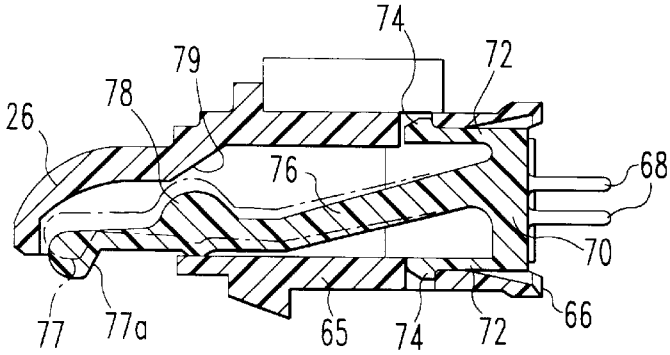
FIG. 12 is a cross-sectional view taken along line DD of FIG. 1 1.

FIG. 10 illustrates a plug connector that is intended to be mounted on a printed circuit board P, rather than being attached to a cable. Such a connector would be utilized in a cradle or holder for the wireless telephone. Connector 64 includes an insulative terminal housing 65 having printed circuit board mounting surface 66 opposite its front face. Terminal tails 68 extend beyond surface 66 and may comprise through-hole or surface mount connections to the printed circuit board P. The front face includes an array of terminals 24 and a pair of location/guidance posts 26. As in previous embodiments, latch pawls 77 are received in the posts 26. FIG. 11 is a top view of the connector shown in FIG. 10. FIG. 12 is a cross sectional view taken along line DD of FIG. 11 and shows the internal construction of connector 64. In this embodiment, a latch base 70 is received within a rear portion of the terminal body 65. The latch base 70 is held in the housing 65 by securing arms 72 carrying engagement lobes 74, that engage openings in the housing 65. A latch arm 76 extends from its fulcrum point at base 70 forwardly through the housing 65 to a distal portion carrying the latching pawl 77 disposed in the location/guidance post 26. The latch arm 76 includes an enlargement 78 for engaging an interior surface 79 of the housing to prevent overstressing of the latch arm 76. Preferably, the assembly comprising the latch base 70, securing arms 72 and latch arm 76 is formed as a one piece integrally molded part that is inserted from the rear into the terminal housing 65.

The connector 64 is generally used in situations where it is generally vertically disposed. In such situations, the weight of the wireless telephone resting against the connector 64 acts to compress the terminals 24. In this situation, the latch arms 76 only needs to provide enough latching force to prevent accidental dislodgment of the telephone from the holder. To disengage the telephone, the user grasps the telephone and pulls it generally axially from the holder. As a consequence, the latching surfaces of the receptacle connector in the telephone bear against pawl surface 77*a* and move the latch arm to the dotted line position shown in FIG. 11. The latch surface 77*a* preferably is canted somewhat more than previous embodiments and/or the spring rate of latch arm 76 is reduced to effect this release action. Thus this type of latch can be characterized as a "passive" latch as opposed to "active" latch requiring a separate release function, as in the FIGS. 1–9 embodiments.

FIG. 13 is an isometric view of a receptacle connector to which the previously illustrated embodiments of plug connectors are mateable. Receptacle connector 80 comprises a housing 82 formed of an insulative material. An array of receptacle terminals 84 having flat plug terminal receiving sections are secured in the housing, with terminal tails 84 adapted to be soldered or otherwise secured onto a printed circuit board on which the connector 80 is mounted. The housing 82 includes a pair of laterally spaced guidance openings 86 adapted to receive the location/guidance posts 26 of the mating plug connector. Each of the guidance openings 86 includes a latch surface for engagement by the latch pawls 32, 46 or 77 of the mating connector. In the embodiment shown in FIG. 13, the latching surfaces are formed by transverse openings 88, the front edges 89 of which are engaged by the latch pawl. Preferably, the housing 82 also includes metal hold down plates 90 that are adapted to be soldered onto the printed circuit board that receives the connector 80.

In use, one large plug connector such as that illustrated in FIG. 4 can be intermated with connector 80 or two smaller connectors, such as generally shown in FIG. 8, can be associated with one receptacle connector 80.

The invention provides several advantages. Because the two latches in the FIG. 1 and FIG. 4 embodiments are interconnected, release of both latches simultaneously is more assured. By the use of a longer latch arm structure, the stresses resulting from cycling of the latches are distributed over a longer arm, thereby contributing to long latch life, particularly in the embodiments using molded plastic latch arms. Further, in the later embodiments using integral plastic latches, the cost of the connectors is reduced by avoiding the need for the assembly of multiple parts.

While the present invention has been described in connection with the preferred embodiments of the various figures, it is to be understood that other similar embodiments may be used or modifications and additions may be made to the described embodiment for performing the same function of the present invention without deviating therefrom. Hence, the present invention should not be limited to any single embodiment, but rather construed in breadth and scope in accordance with the recitation of the appended claims.

What is claimed is:

1. A connector for establishing an electrical connection with a mating connector comprising:

a terminal housing having a front face for mating with the mating connector and a rear portion in opposed relation to the front face;

a plurality of contact terminals disposed along said front face;

a projection extending forwardly from said front face for engaging guidance structure in the mating connector;

at least two biased latch arms joined by a cross member insuring common and simultaneous activation of both arms, each arm having a distal portion with a latch pawl disposed in said projection, an intermediate portion extending along said housing and a proximal portion forming a fulcrum for the latch arm disposed at said rear portion;

a cover overlying said housing and an actuator means associated with the latch arm for moving the latch pawl to a disengaging position and wherein the fulcrum of the latch arm is secured on the cover.

2. The connector as in claim 1, wherein the latch arm is integral with the cover.

3. The connector as in claim 2, wherein the cover and the latch arm integrally molded.

4. The connector as in claim 1, wherein said projection comprises a first projection and said front face includes a second forwardly extending projection laterally spaced from the first projection and a second latch arm having a distal portion with a latch pawl disposed in the second projection, an intermediate portion extending along the housing and a proximal portion forming fulcrum for the second latch arm secured on the cover; and an actuating means secured to the first and second latch arms for moving the latch pawls to a disengaging position.

5. The connector as in claim 4, wherein the cover is formed of a moldable material and the first and second latch arms are integrally molded with the cover.

6. The connector as in claim 5, wherein the actuating means is integrally molded with the first and second latch arms and the cover.

7. A connector for establishing an electrical connection with a mating connector comprising:

a terminal housing having a front face for mating with the mating connector and a rear portion in opposed relation to the front face;

a plurality of contact terminals disposed along said front face;

at least two biased latch arms joined by a cross member insuring common and simultaneous activation of both arms, each arm having a distal portion with a latch pawl positioned to engage the mating connector and a proximal portion forming a fulcrum for the latch arm; and a cover overlying said housing, wherein the fulcrum of the latch arm is secured on the cover.

8. The connector as in claim 7, wherein the latch arm is integral with the cover.

9. The connector as in claim 8, wherein the cover and the latch arm are integrally molded.

10. The connector as in claim 7 and further comprising a second latch arm having a distal portion with a latch pawl positioned to engage the mating connector along a proximal portion forming fulcrum for the second latch arm secured on the cover; and an actuating means secured to the first and second latch arms for moving the latch pawls to a disengaging position.

11. The connector as in claim 10, wherein the cover is formed of a moldable material and the first and second latch arms are integrally molded with the cover.

12. The connector as in claim 11, wherein the actuating means is integrally molded with the first and second latch arms and the cover.

* * * * *